United States Patent [19]

Petursson

[11] Patent Number: 4,622,701

[45] Date of Patent: Nov. 18, 1986

[54] MECHANICAL WASTE MECHANISM

[76] Inventor: Sigurdur G. Petursson, 2169 Linby Street, Mississauga, Ontario, Canada, L4Y 1V6

[21] Appl. No.: 780,180

[22] Filed: Sep. 26, 1985

Related U.S. Application Data

[63] Continuation of Ser. No. 641,756, Aug. 17, 1984, abandoned.

[51] Int. Cl.[4] ..... E03C 1/22

[52] U.S. Cl. ..... 4/203; 4/199; 251/294

[58] Field of Search ..... 4/197–206, 4/191, 195, 194; 251/294

[56] References Cited

U.S. PATENT DOCUMENTS

| | | | |
|---|---|---|---|
| 1,547,764 | 7/1925 | Kuehl | 4/203 |
| 1,704,510 | 3/1929 | Muend | 4/203 |
| 2,706,298 | 4/1955 | Holycross, Jr. | 4/199 |
| 2,859,453 | 11/1958 | Bloch | 4/199 |
| 2,910,704 | 11/1959 | Kinsey et al. | 4/199 |

FOREIGN PATENT DOCUMENTS

| | | | |
|---|---|---|---|
| 453957 | 12/1949 | Italy | 4/199 |
| 478911 | 3/1953 | Italy | 4/199 |
| 561953 | 5/1957 | Italy | 4/203 |

*Primary Examiner*—Stephen Marcus
*Assistant Examiner*—Linda J. Sholl
*Attorney, Agent, or Firm*—D. Eggins

[57] ABSTRACT

A rocker beam construction for use with plumbing fixtures, for insertion within a drain tube to transmit stopper opening motion from a drain actuating linkage acting at one end of the drain tube, to the stopper located at the other end of the drain tube, comprises a unitary beam having a relatively thin deep substantially flat subsection transversely flexible relative to the plane of the web, which may be inserted within the drain tube by turning the beam on its side and bending it down through the drain aperture and into the drain tube, where it is repositioned having the web thereof in a vertical plane for engagement by the actuating linkage in a downward depressing motion, the improved device having a post portion connecting one end of the rocker beam with the stopper, to transfer rocking downward displacement of the beam by the actuating linkage into upward rocking displacement of the stopper means. The post-to-stopper construction permits the use of an interposed locking collar to preclude to preclude unauthorized removal of the beam and stopper assembly.

13 Claims, 9 Drawing Figures

MECHANICAL WASTE MECHANISM

This is a continuation of application Ser. No. 06/641,756 filed 08/17/84, now abandoned.

BACKGROUND OF THE INVENTION

This invention is directed to drain actuating mechanisms, and in particular to a rocker beam linkage for interconnecting an actuating linking with drain stopper means.

In the prior art the use of drain actuating mechanisms employing rocker beams spanning the drain tube to impart opening motion to the drain stopper are well known. Such prior art rocker beams are multi-member pivoted constructions, often requiring the provision of external fulcrum means, and generally being difficult to assemble within the drain tube. Despite such difficulties of insertion, such prior art arrangements are not generally vandal proof, so that often the stopper is stolen from the fixture, or the mechanism is vandalized in some other fashion.

Certain of the prior art is characterized by U.S. Pat. No. 2,910,704 Kinsey et al which shows a horizontally extending waste discharge tubing arranged in sealing relation with a waste outlet opening having a prop-up valve. A curved, substantially rigid lever arm extends for a substantial distance within the waste discharge tubing, the lever being of such construction as to stiffen the lever to permit little or no bending or other distortion. Rocking movement of the curved lever serves to control the opening or closing of the pop-up valve. The lever arm is curved and so shaped as to be insertable and withdrawable in relation to the waste discharge tubing through the waste outlet opening, having clearances such that no marring of the interior of the tubing occurs during insertion or removal thereof. However this construction suffers from the disadvantage that it provides no effective obstruction to the ready removal, such as by vandals, of the curved lever arm through the waste outlet opening. A somewhat similar arrangement by Holycross, in U.S. Pat. No. 2,706,298, having a multi-component articulated lever arm, suffers from the same deficiency.

The present invention provides a simplified unitary rocker beam for use in cooperation with existing actuating mechanisms and plumbing fixtures, and incorporating a fastening means to substantially preclude unauthorized removal of the stopper means, so as to substantially vandal proof the fixture installation.

Thus there is disclosed a drain actuator linkage for use in cooperation with a plumbing fixture drain system having a drain tube connected substantially at 90° in liquid receiving relation with the fixture drain outlet, the system having stopper means controlling flow through, and normally closing the drain outlet a, manually operable control actuator reciprocably connected with the end of the drain tube remote from the drain outlet, the subject actuator linkage including unitary, transversely flexible rocker beam means insertable on its side at 90° to its operating orientation, having sufficient flexibility to traverse the substantially 90° bend connecting the drain outlet with the drain tub without taking a permanent set, thereby being inserted in transversely flexed relation through the drain outlet into the drain tube and then 90° to extend in a vertically oriented motion-transmitting relation between the actuator linkage and the outlet, and post means connecting the rocker beam means to the stopper means in motion transmitting relation therebetween whereby, in use the rocker beam transmits downward displacement of the control actuator into upward, opening displacement of the stopper means whilst connection of the stopper means to the post means precludes reorientation of the beam means into its side for withdrawal from the system.

The present invention lends itself to low cost beam construction using flexible metal or plastic material capable of the desired degree of transverse elastic bending for insertion within the drain tube, while having sufficient longitudinal beam stiffness, in the plane of the web material, to transmit the necessary actuating forces to the stopper means.

In addition to the advantage of simplified insertion, the unitary beam, being free of intermediate joints, promotes free, laminar flow, with reduced likelihood of fouling by hair entanglement etc. In addition to the foregoing advantages, the unitary beam, having a post pivotally secured to one end thereof, may not be readily withdrawn from the drain, in view of the necessity to rotate the beam through 90° preparatory to bending it upwardly to exit the drain opening. This 90° rotation can be effected using an insert tool, or pliers. However, the provision of locking collar means preventing unauthorized removal of the stopper effectively prevents ready vandalization of the stopper and actuating mechanism.

The subject unitary beam arrangement may be utilized incorporating liquid deflector surfaces to assist in maintaining the stopper means held in the open condition while drainage takes place.

The beam arrangement also lends itself to a two-sided beam construction.

BRIEF DESCRIPTION OF THE DRAWINGS

Certain embodiments of the invention are described, reference being made to the accompanying drawings, wherein.

DETAILED DESCRIPTION OF PREFERRED EMBODIMENTS OF THE INVENTION

Figure 1:
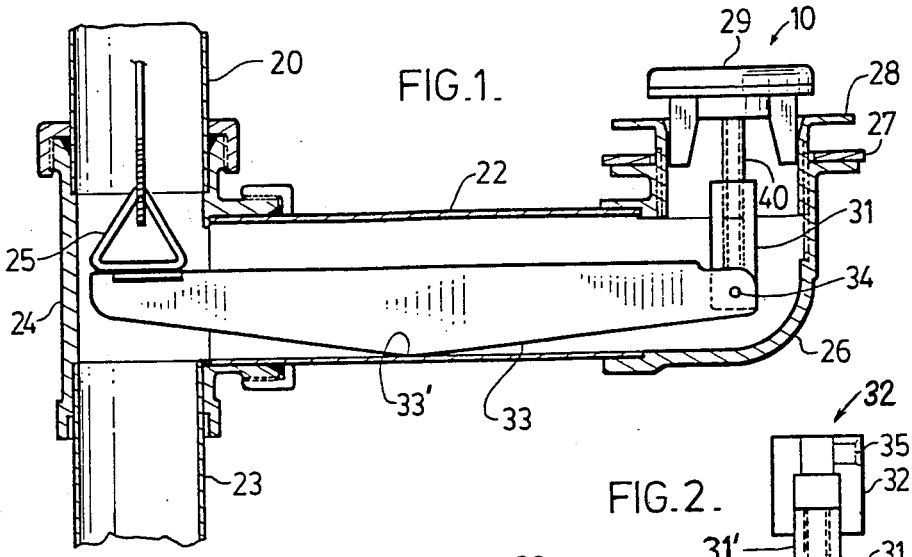
FIG. 1 is a side elevation in diametrical section of the assembled associated hardware incorporating the subject beam and attachment post.

Referring to FIG. 1 the assembled hardware 10 comprises an overflow tube 20 connected by drain tee 24 with a horizontal drain tube 22 connected to drain elbow 26, showing a tub gasket 27 and drain inlet 28. An outlet drain tube 23 extends downwardly from the drain tee 24.

A conical actuator mass 25 is connected with manual operating means (not shown), and extends to the outer end of the drain tube 22.

The subject rocker beam 33 of substantially planar form has a thin deep section a widened fulcrum portion 33' about which the beam 33 tilts. A post portion 31 pivotally connected at 34 to the beam 33 has a central threaded aperture within which the threaded stem 40 of the stopper 29 is inserted.

In one embodiment a locking collar 32 having a grub screw 35 is interposed between the stopper means 29 and the post 31. Downwardly depending arm portions 32 of the collar 32' preclude relative rotation between the collar 32 and flatted abuttment portions 31' of the hexagonal post 31, and the grub screw 35 is engaged in jamming relation with the stem 40, to prevent rotation thereof.

An allen key used with the grub screw permits installation and removal of the stopper means, thereby effectively precluding vandalization or thievery.

Figure 5:
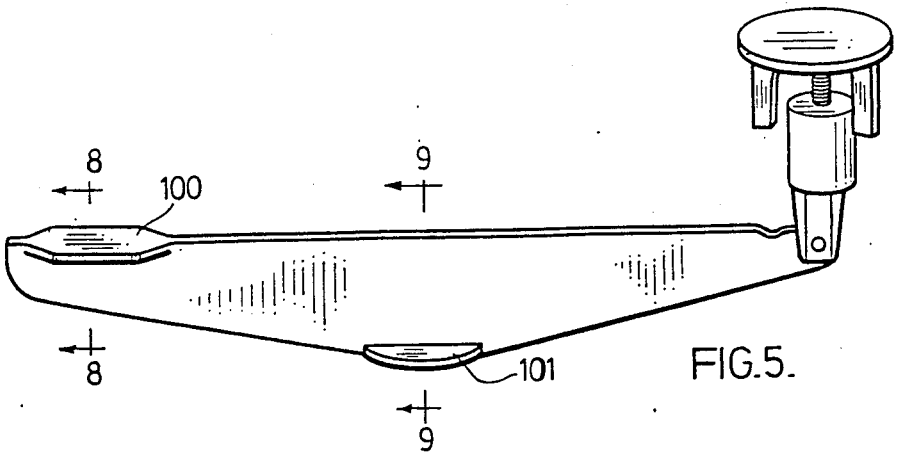
FIG. 5 is a general view of a further beam embodiment and stopper means.

In the FIG. 5 embodiment transversely extending local enlargements of the beam lend additional stability and enlarged contact areas to the beam web.

Figure 6:
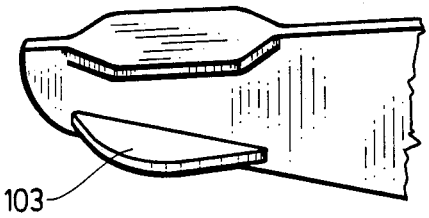
FIG. 6 is a detail end view of an embodiment having a deflector.
Figure 7:
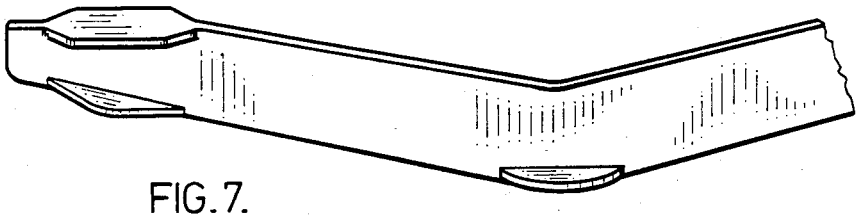
FIG. 7 is a general view of a further embodiment.
Figure 8:
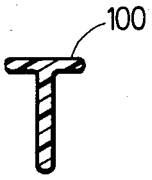
FIG. 8 is a section taken at 8—8 of FIG. 5.
Figure 9:
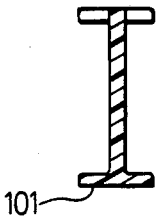
FIG. 9 is a section taken at 9—9 of FIG. 5.

In the FIG. 6 embodiment an inclined deflector surface 103 provides interaction with liquid flowing therepast, when in a position to open the stopper means, thereby diminishing the force requiring to be maintained externally to hold the stopper open As will be seen from FIGS. 8 and 9 the locally enlarged portion 100 and 101 serve to diminish contact load pressures acting on the beam, whilst having little effect on the transverse flexibility in regard to installation and resilience.

Figure 2:
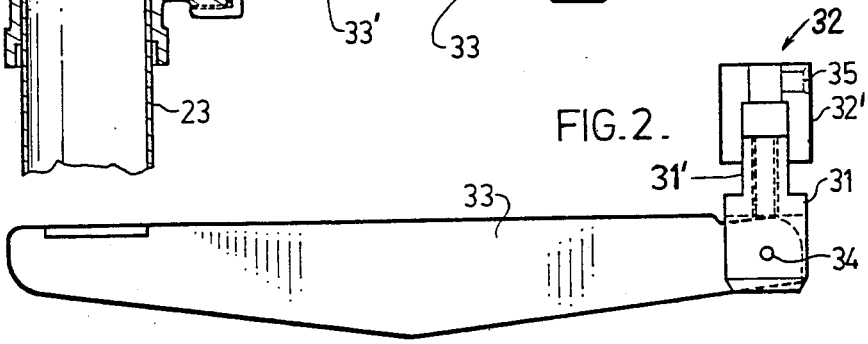
FIG. 2 is a side view of the subject rocker beam, with attached post, and locking collar.
Figure 3:
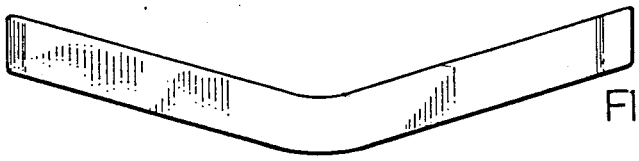
FIG. 3 is an alternative form of unitary beam.
Figure 4:
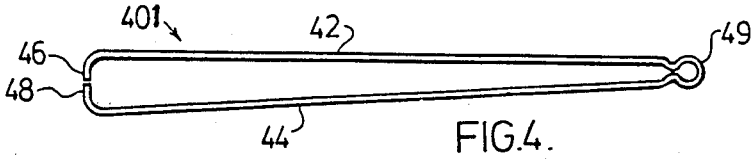
FIG. 4 is a plan view of a two sided beam embodiment.

In the case of the FIG. 4 embodiment, which may have a shape, viewed in elevation such as that of FIG. 2 or FIG. 3, the beam 40' has opposed side walls 42,44, inturned end portions 46,48 and a hollow boss portion 49 to receive an interconnecting post (not shown) in downwardly inserted relation therein. The boss portion 49 may be threaded, if desired. Owing to the use of thin material the requisite degree of bending of the beam in a transverse sense for entering the drain tube 22 is readily provided, without causing permanent set, whilst the spaced apart walls 42, 44 promote the stability of the beam in transmitting actuating motion to the stopper means 29. The unitary nature of the beam 40 promotes low cost fabrication by simple stamping and bending operations.

A wide range of material may be selected from, in order to make the various embodiments of the invention, including sheet metal of a gauge such as 24 gauge.

Thus, a selection can be made of metal or plastic. Carbon steel may require painting or other protection if rusting is unacceptable. Monel metal, spring brass, hardenable stainless steel of Type 400 series or austenitic type 18-8 or 316 are a few of the useful metals.

In the case of plastics polysulfone, polycarbonate, CELCON TM, DELRIN TM, nylon, ABS, to name but a few have suitable engineering characteristics, and lend themselves to casting injection molding or forming from sheet. Evidently the FIG. 5 embodiment is probably most easily made by injection moulding.

The use of filled plastics using reinforcement such as glass fibres is also contemplated.

In the case of the FIG. 4 embodiment it will be appreciated that deflector vanes similar to the vanes 103 shown in FIG. 6 may be readily provided by an outturning of the bottom corner of the sides 42,44 to a desired extent to provide the requisite angle.

By virtue of the modified forces acting on the flexible beam, the force required to maintain the stopper means in the open position can be effectively reduced, thereby making it possible to employ an appreciably lighter weight 25.

What I claim by Letters Patent of the United States is:

1. A plumbing fixture having drainage provision comprising a drain outlet, a substantially horizontal drain tube connected to said outlet through an angled connection, said tube being located in spaced relation beneath said outlet, rocker beam having a length to extend through said horizontal drain tube, said rocker beam being of thin, deep cross-section to provide a planar section of sufficient depth so that said rocker beam cannot pass through said connection and drain outlet when said section is in a planar condition, the thickness of said planar section permitting said beam to be manually resiliently deformed in a direction perpendicular to said plane in an amount sufficient for insertion through said outlet and said connection, actuator means adjacent one end of said drain tube remote from said drain outlet for cooperation with said rocker beam to displace the adjacent end of said beam to rock the beam, and a post secured to the other end of said beam and connected to a stopper located in said drain outlet, to selectively open or to permit the closure of said drain outlet upon rocking of said rocker beam, said post holding said beam in a vertical plane.

2. The drain actuator linkage as set forth in claim 1, said rocker beam comprising a transversely flexible beam web having a protruding fulcrum portion along one edge intermediate the ends thereof for contacting an inner wall portion of said drain tube in longitudinal rocking motion thereagainst.

3. The drain actuator linkage as set forth in claim 2, wherein said beam web comprises flexible material selected from metal and plastic sheet material.

4. The drain actuator linkage as set forth in claim 2, said rocker beam being substantially planar and having a locally thickened end portion adjacent a load transfer zone with said actuator linkage, and a locally thickened intermediate portion at said fulcrum portion.

5. The drain actuator linkage as set forth in claim 1, said post engaging a threaded portion of said stopper in securing engagement therewith.

6. The drain actuator linkage as set forth in claim 1, having said post pivotally secured to said rocker beam, an axially extending threaded portion of said post engaging an axially extending threaded portion of said stopper, and locking means interconnecting said post with said stopper to preclude relative polar rotation therebetween, whereby removal of said stopper is prevented.

7. The drain actuator linkage as set forth in claim 1, having said post pivotally secured to said rocker beam, said post having a threaded aperture therein to receive a threaded stem portion of said stopper in threaded engagement therein, and locking means extending between said post and said stopper having abuttment means at one end thereof to preclude relative rotation between said abuttment means and the adjoining said means, and adjustable screw means at the other end of said locking means for securing the locking means to the adjoining other said means.

8. The drain actuator linkage as set forth in claim 1, in combination with said drain tube, and said stopper also set forth therein.

9. The drain actuator linkage as set forth in claim 1, said rocker beam having deflector means extending transversely therefrom adjacent one end thereof, to provide a reaction surface responsive to the flow of liquid therepast, to moderate the forces acting on said rocker beam.

10. The drain actuator linkage as set forth in claim 1, said rocker beam having a transversely enlarged beam lower edge portion providing a fulcrum zone of extended transverse dimension to impart enhanced stability to said beam.

11. The drain actuator linkage as set forth in claim 10, said rocker beam having a transversely enlarged beam upper edge portion providing a contact zone of enlarged transverse dimension to provide said actuating linkage with an enlarged contact area.

12. The drain actuator linkage as set forth in claim 1, said flexible rocker beam having a pair of substantially parallel wall portions, and a boss portion at one end thereof in interconnecting relation between said wall portions.

13. The linkage as claimed in claim 12, said rocker beam being fabricated from metal sheet.

* * * * *